US008695256B2

(12) United States Patent
Landsman et al.

(10) Patent No.: US 8,695,256 B2
(45) Date of Patent: Apr. 15, 2014

(54) RECIPIENT VERIFICATION SYSTEM AND METHODS OF USE, INCLUDING RECIPIENT IDENTIFICATION

(71) Applicant: Typenex Medical, LLC, Chicago, IL (US)

(72) Inventors: Kelly M. Landsman, Fitchburg, WI (US); Varsha Kalyankar, Chicago, IL (US); Luke A. Westra, Chicago, IL (US)

(73) Assignee: Typenex Medical, LLC, Chicago, IL (US)

( * ) Notice: Subject to any disclaimer, the term of this patent is extended or adjusted under 35 U.S.C. 154(b) by 0 days.

(21) Appl. No.: 13/946,474

(22) Filed: Jul. 19, 2013

(65) Prior Publication Data

US 2013/0305577 A1 Nov. 21, 2013

Related U.S. Application Data

(63) Continuation of application No. 13/352,108, filed on Jan. 17, 2012, and a continuation-in-part of application No. 12/465,449, filed on May 13, 2009.

(60) Provisional application No. 61/433,009, filed on Jan. 14, 2011, provisional application No. 61/052,811, filed on May 13, 2008.

(51) Int. Cl.
*A44C 5/00* (2006.01)

(52) U.S. Cl.
USPC ..... 40/633; 283/75

(58) Field of Classification Search
USPC ..... 40/633, 665; 283/70, 75
See application file for complete search history.

(56) References Cited

U.S. PATENT DOCUMENTS

| | | | |
|---|---|---|---|
| 3,106,028 | A | 10/1963 | Baumgartner |
| 3,323,208 | A | 6/1967 | Hurley |
| 3,416,200 | A | 12/1968 | Daddona, Jr. |
| 3,586,220 | A | 6/1971 | Reinsberg |
| 3,645,023 | A | 2/1972 | Larson |
| 3,656,247 | A | 4/1972 | Bushnell et al. |
| 3,660,916 | A | 5/1972 | McDermott et al. |
| 3,698,383 | A | 10/1972 | Baucom |
| 3,715,570 | A | 2/1973 | Weichselbaum et al. |
| 3,744,104 | A | 7/1973 | Ford |
| 3,744,691 | A | 7/1973 | Shears |
| 3,751,835 | A | 8/1973 | Smith |
| 3,965,589 | A | 6/1976 | McDermott |
| 4,164,320 | A | 8/1979 | Irazoqui et al. |
| 4,226,036 | A | 10/1980 | Krug |
| 4,233,715 | A | 11/1980 | McDermott |
| 4,377,047 | A | 3/1983 | Adams, Jr. et al. |
| 4,914,843 | A | 4/1990 | DeWoskin |

(Continued)

*Primary Examiner* — Joanne Silbermann
(74) *Attorney, Agent, or Firm* — Dicke, Billig & Czaja, PLLC

(57) ABSTRACT

A recipient verification system including a band having a base, a strap, and a closure device. The base defines a band identification portion for displaying a recipient identifier. The strap extends from the base, and the closure device is attached to the base opposite the strap. First and second slots are formed through the band. In a primary worn state, the strap is looped about a recipient's appendage and secured to the base via the closure device independent of the slots. In a replacement worn state, the base is severed from a majority of the strap and is secured to the recipient's appendage by a secondary band assembled through the slots.

18 Claims, 4 Drawing Sheets

(56) References Cited

U.S. PATENT DOCUMENTS

| | | | |
|---|---|---|---|
| 5,002,212 | A | 3/1991 | Charleton |
| 5,088,159 | A | 2/1992 | Lafleur |
| 5,092,067 | A | 3/1992 | Prout |
| 5,164,575 | A | 11/1992 | Neeley et al. |
| 5,166,498 | A | 11/1992 | Neeley |
| 5,226,809 | A | 7/1993 | Franco |
| 5,283,969 | A | 2/1994 | Weiss |
| 5,311,689 | A | 5/1994 | Lindsey |
| 5,323,554 | A | 6/1994 | MacDonald |
| 5,343,608 | A | 9/1994 | MacDonald |
| 5,401,110 | A | 3/1995 | Neeley |
| 5,423,574 | A | 6/1995 | Forte-Pathroff |
| 5,488,846 | A | 2/1996 | Green |
| 5,499,468 | A | 3/1996 | Henry |
| 5,581,924 | A | 12/1996 | Peterson |
| 5,615,504 | A | 4/1997 | Peterson et al. |
| 5,740,623 | A | 4/1998 | Juhan et al. |
| 5,758,443 | A | 6/1998 | Pedrazzini |
| 5,979,941 | A | 11/1999 | Mosher, Jr. et al. |
| 6,092,321 | A | 7/2000 | Cheng |
| 6,255,951 | B1 | 7/2001 | De La Huerga |
| 6,349,493 | B1 | 2/2002 | Newman et al. |
| 6,421,920 | B1 | 7/2002 | Jensen |
| 6,655,063 | B2 | 12/2003 | Goodin et al. |
| 6,748,687 | B2 | 6/2004 | Riley |
| 6,922,148 | B2 | 7/2005 | Despotis |
| 6,948,271 | B2 | 9/2005 | Helgeson et al. |
| 6,976,327 | B2 | 12/2005 | Goodin et al. |
| 7,017,293 | B2 | 3/2006 | Riley |
| 7,017,294 | B2 | 3/2006 | Riley |
| 7,137,216 | B2 | 11/2006 | Ali et al. |
| 7,188,764 | B2 | 3/2007 | Penuela |
| 7,197,842 | B2 | 4/2007 | Ali |
| 7,222,448 | B2 | 5/2007 | Riley |
| 7,240,446 | B2 | 7/2007 | Bekker |
| 7,286,055 | B2 | 10/2007 | Girvin et al. |
| 7,481,370 | B2 | 1/2009 | Davis et al. |
| 8,028,450 | B2 | 10/2011 | Landsman et al. |
| 2004/0060216 | A1 | 4/2004 | Riley |
| 2004/0148836 | A1 | 8/2004 | Riley |
| 2004/0244251 | A1 | 12/2004 | Riley |
| 2005/0091896 | A1 | 5/2005 | Kotik et al. |
| 2005/0108912 | A1 | 5/2005 | Bekker |
| 2005/0184508 | A1 | 8/2005 | Verden et al. |
| 2006/0174527 | A1 | 8/2006 | Henley |
| 2006/0230661 | A1 | 10/2006 | Bekker |
| 2006/0242875 | A1 | 11/2006 | Wilson et al. |
| 2006/0254105 | A1 | 11/2006 | Chang |
| 2007/0028495 | A1 | 2/2007 | Kotik et al. |
| 2007/0120358 | A1 | 5/2007 | Waggoner et al. |
| 2007/0172291 | A1 | 7/2007 | Yokoyama |
| 2008/0028654 | A1* | 2/2008 | Cardon et al. ..... 40/633 |
| 2008/0301990 | A1 | 12/2008 | McDermott |
| 2010/0024268 | A1 | 2/2010 | Landsman et al. |
| 2011/0107637 | A1 | 5/2011 | Bekker |
| 2012/0180351 | A1 | 7/2012 | Kalyankar et al. |

* cited by examiner

RECIPIENT VERIFICATION SYSTEM AND METHODS OF USE, INCLUDING RECIPIENT IDENTIFICATION

CROSS-REFERENCE TO RELATED APPLICATION

This application is a continuation of U.S. application Ser. No. 13/352,108, filed Jan. 17, 2012, which claims priority under 35 U.S.C. §119(e)(1) to U.S. Provisional Patent Application Ser. No. 61/433,009, filed Jan. 14, 2011, the entire teachings of which are incorporated herein by reference, and which is a continuation-in-part of U.S. application Ser. No. 12/465,449, filed May 13, 2009, now U.S. Pat. No. 8,099,889, which claims priority under 35 U.S.C. §119(e)(1) to U.S. Provisional Patent Application Ser. No. 61/052,811, filed May 13, 2008.

BACKGROUND

The present disclosure relates to recipient verification bands and related systems, for example patient identification systems. More particularly, it relates to wearable verification bands for use in various environments, such as caregiver environments. Said verification bands provide users with various labels and labeling methods, which can be linked to the wearer of the band. The systems described in the present disclosure are amenable for various end applications and methods for making the same.

The need to assign a unique code or other identifier to a person or thing (collectively referred to as a "recipient") and to employ the identifier in correlating articles or activities to the recipient arises in a number of contexts. For example, positive patient identification is a critical step in providing medical treatment to patients in a caregiver environment (e.g., hospital). Commonly, an identification band (e.g., a flexible plastic wristband or ankle band) is issued to the patient at the time of admission to the caregiver institution, and is worn by the patient at all times (sometimes referred to as an "admission band"). The issued identification/admission band typically displays patient-related information (e.g., printed or labeled), such as name, date of birth, etc.

In some instances, a unique patient identifier or other code is assigned to the patient and is displayed on the admission band, including, for example, a bar code or numeric/alphanumeric code. The patient identifier can alternatively be supplied on a separate band (apart from the admission band), and is used to cross-reference other caregiver-related items with the patient via, for example, an electronic data base. The unique patient identifier provides an independent, physical link between the patient and associated patient articles or caregiver activities when applied to such articles. For example, paperwork or other caregiver documents/medical charts relating to the patient may include the patient identifier. In addition, the patient identifier can be applied to specimen samples (e.g., test tubes for blood specimens) taken from the patient, or applied to therapeutic material(s) to be given to the patient. The patient identifier ensures that said items are accurately associated with the correct patient at all stages of the patient's visit with the caregiver institution. Similar recipient verification needs apart from hospital admission may be found in multiple other situations including blood transfusion, pharmaceutical administration, trauma centers, etc. In these and other environments, a lack of immediate patient identification and verification can pose significant safety risks.

To facilitate accurate transposition of the patient identifier (and possibly other patient-related information) to items apart from the band(s) worn by the patient, it is known to provide one or more labels or tags that display the same patient identifier. Alternatively, it is also known to permit a caregiver to enter the patient identifier onto the label/tag. This manual process of transferring the patient identifier from the patient to his specimens, test requests, etc. and then back to the patient is prone to error. First, if the unique patient identifier or patient information must be transcribed by hand, the potential for human error will arise. Second, the patient identifier and/or patient information must be transferred to the correct specimen/item in question. In order to avoid transcription errors, it is desirable to use these patient identification labels in combination with the unique patient identifier. Hospital admission bands are commonly supplied with a plurality of patient identifying labels. In addition, laboratory test requests often can generate multiple patient identifying labels. In all these scenarios, the companion labels with the matching patient identifier information are separate from the patient identifier attached directly to the patient. This lack of direct physical connection can lead to confusion, lost labels, and other problems.

While systems exist that address several of the problems raised above, current systems also give rise to other concerns. For example, the need for removal, replacement and/or relocation of bands placed around patient extremities arises due to a number of reasons including lack of comfort, lack of access, swelling, and loss of durability. It is desirable to have a way to reattach a band after it has been removed and replace it on an extremity and/or alternate location on the body. Alternate location attachment (i.e. not attached around a wrist or ankle) is also desirable in cases where the band does not fit the patient, access is restricted, or the patient has a restricted extremity, among other reasons. A need exists for an improved recipient verification system that addresses the above challenges.

SUMMARY

Some aspects in accordance with principles of the present disclosure relate to a recipient verification system including a band. The band includes a base, a strap and a closure device. The base defines a band identification portion for displaying a recipient identifier. First and second slots are formed through a thickness of the band. The strap defines a first end, a second end opposite the first end, and an intermediate segment between the first and second ends. The first end is contiguously formed with the base such that the strap extends from the base to the second end. The closure device is attached to the base opposite the first end of the strap. The band is configured to provide a worn state of the system in which the intermediate segment of the strap is looped about a recipient's appendage and is secured to the base by the closure device independent of the slots. A secondary band is optionally provided for securing the base to the recipient's appendage via the slots in a replacement worn state.

Other aspects of the present disclosure relate to a method of applying a recipient verification system to a recipient. The method includes receiving a band including a base, a strap, and a closure device. The base defines a band identification portion for displaying a recipient identifier. First and second slots are formed through a thickness of the band. The strap defines a first end, a second end opposite the first end, and an intermediate segment between the first and second ends. The first end is contiguously formed with the base such that the strap extends from the base to the second end. The closure device is attached to the base opposite the first end of the strap. The intermediate segment is looped about an appendage of the recipient and secured to the closure device to establish a primary worn state. In this regard, the step of securing is accomplished without the strap passing through either of the slots. In some embodiments, the base is subsequently severed from the closure device and a majority of the strap, and re-secured to the recipient's appendage by a secondary band assembled through the slots.

DETAILED DESCRIPTION

Aspects of the present disclosure relate to recipient verification systems useful in a variety of different environments. For example, the recipient verification systems of the present disclosure can be used in medical or patient-related contexts, such as with patient admission to a hospital (and related medical records, charts, items (e.g., clothing), etc.), testing or specimen drawing (e.g., X-rays, blood specimen, DNA specimen, organ donation, stem cell specimen, fertilized eggs, etc.) entirely apart from (or as part of) a hospital stay, blood banks, pharmacies (e.g., custom chemotherapy drugs, nuclear pharmacy, labor and delivery, etc.), or other instances in which patient identification is needed. Other applications are equally appropriate, such as police or security situations in which a number of individuals must be quickly processed on-site, ticketing applications, etc. Thus, while several of the examples described below mention patient identification, as well as hospital admission, the systems of the present disclosure are in no way limited.

Figure 1A:
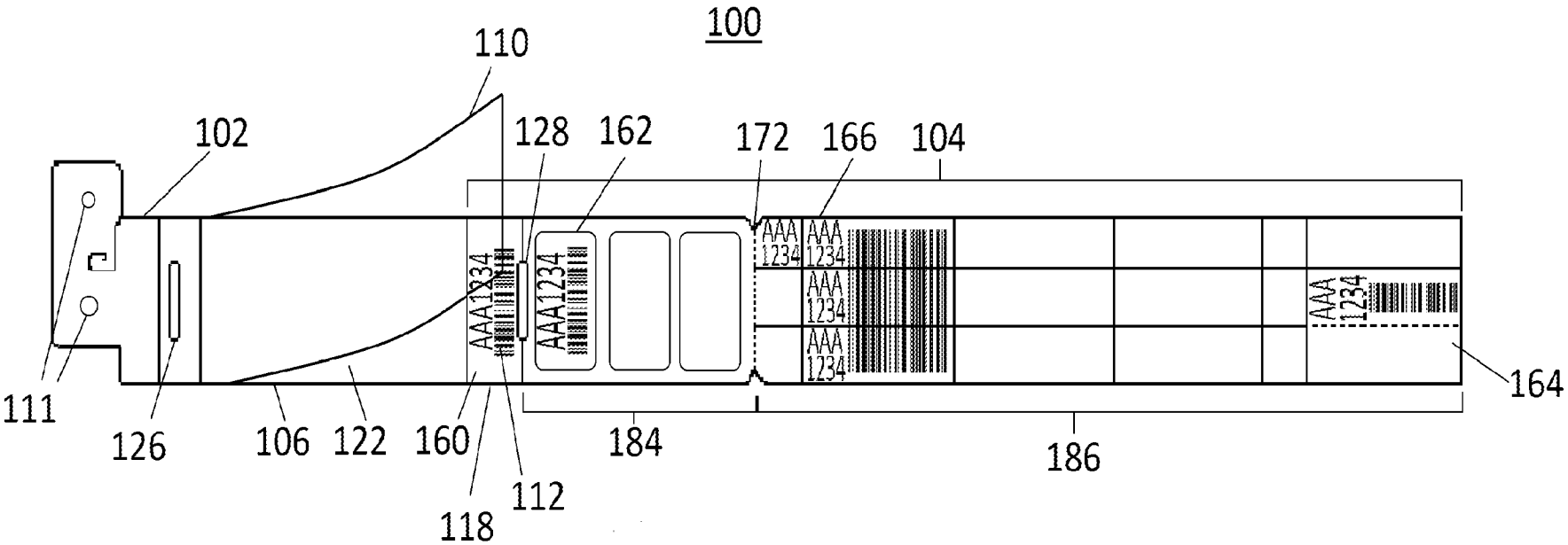
FIG. 1A is a simplified top view of a recipient verification system in accordance with the principles of the present disclosure before application of the system to a recipient.
Figure 1B:
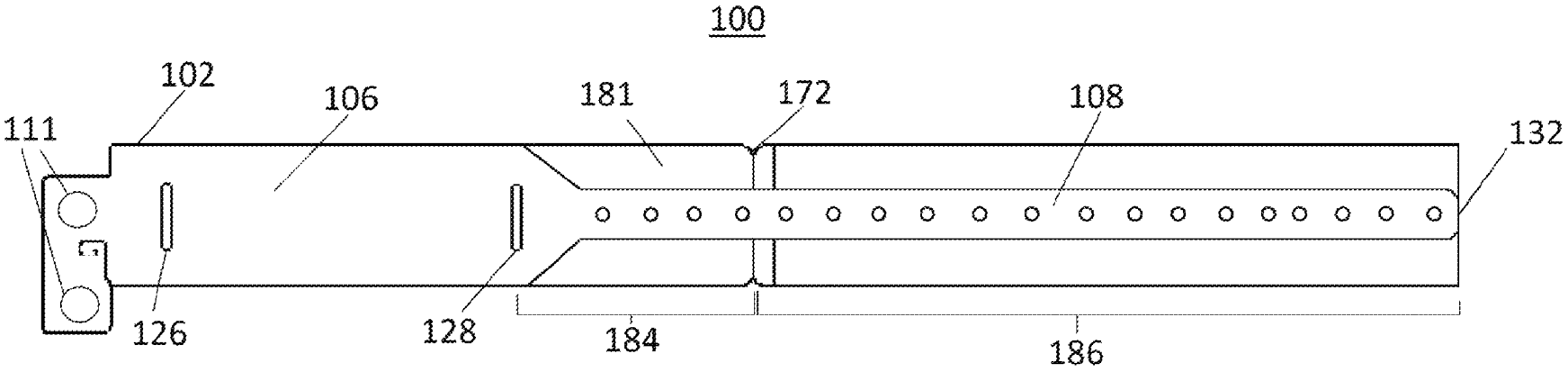
FIG. 1B is a simplified bottom view of the system of FIG. 1A.
Figure 1C:
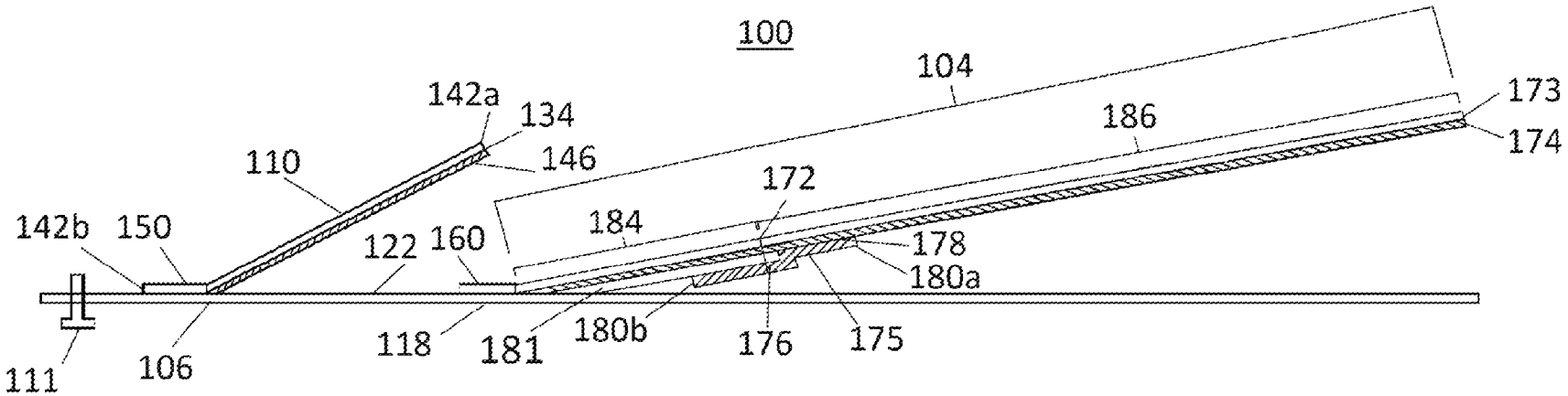
FIG. 1C is a simplified side view of the system of FIG. 1A and illustrates the system layers.

A recipient verification system 100 in accordance with aspects of the present disclosure is shown in FIGS. 1A, 1B, and 1C. As shown in FIG. 1A, the recipient verification system 100 includes a band 102 and a label strip 104. In general terms, the band 102 includes or defines a base 106, a strap 108 (hidden in FIG. 1A, but visible in FIG. 1B), a shield 110, and a closure 111. The label strip 104 extends from the base 106 along (but not attached to) the strap 108 and displays a predetermined band identifier 112 on a permanent label 160. In the embodiment shown in FIG. 1A, the predetermined band identifier 112 is shown in both human readable alphanumeric format and in machine readable barcode format.

The recipient verification system 100 transitions from an initial state, in which the strap 108 shown in FIG. 1B is free of the closure 111, to a worn state in which the strap 108 is wrapped about a recipient's appendage and secured to the base 106 at the closure 111. In the initial or the worn state, the predetermined band identifier 112 may be protected by and visible through the shield 110. In some embodiments, the base 106 and the strap 108 are constructed by a material web including a bottom layer adapted for contact with human skin.

As shown in FIG. 1C, the base 106 defines a band identification portion 118. The predetermined band identifier 112 (not visible in FIG. 1C, but shown in FIG. 1A) is displayed on the band identification portion 118 by the permanent label 160. In the embodiment shown, the permanent label 160 is a contiguous section of the label strip 104. In alternative embodiments, the permanent label 160 can be a separate label that is non-contiguous with the label strip 104. Alternatively in another embodiment, the predetermined band identifier 112 may be applied to the base 106 by direct printing without the use of a label.

In some embodiments, the base 106 also defines an optional recipient information portion 122 sized to receive a recipient information label (e.g., a hospital label). For reference, the recipient information label is absent from FIGS. 1A-1C to better illustrate the recipient information portion 122. In other embodiments, the material of the label strip 104 may be lengthened such that a section of the label strip 104 is coextensive with the base 106 over the recipient information portion 122. In this embodiment, the recipient information label applied to the recipient information portion 122 would be adhered to the surface of the label strip 104 rather than to the surface of the base 106. The recipient information portion 122 may contain prompts that instruct the caregiver to place a recipient information label onto that location. In other embodiments, the recipient information portion 122 can have a shorter length than implicated by the drawings to provide a limited area for the caregiver to apply patient-related information (e.g. patient date-of-birth, etc.).

Figure 3A:
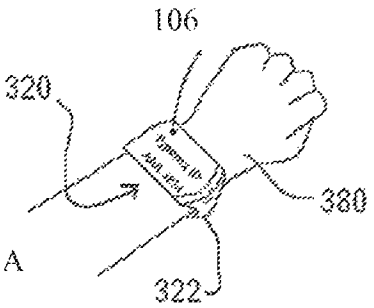
FIGS. 3A-3E illustrate implementation of a replacement band in accordance with principles of the present disclosure.
Figure 3B:
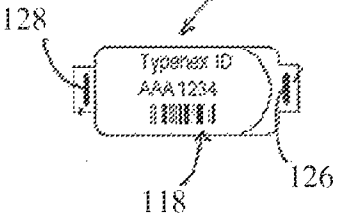

As shown in FIGS. 1A and 1B, the base 106 further defines first and second passages or slots 126, 128 through a thickness thereof. The first and second passages 126, 128 are formed at opposing sides of the base 106 in a manner not obstructing the predetermined band identifier 112. The first and second passages 126, 128 are sized to receive a separate attachment device strap (not shown) in an alternate worn state or replacement worn state. In this alternate worn state or replacement worn state configuration, the first and second passages 126, 128 function as part of a band replacement feature as described in U.S. application Ser. No. 12/465,449 filed May 13, 2009 and entitled "Recipient Verification Systems and Methods of use, Including Patient Identification," the entire teachings of which are incorporated herein by reference. For example, and with reference to FIGS. 3A-3E, the band 102 (as well as the label strip (not shown) carried thereby) is secured about a recipient's wrist 380 as illustrated in FIG. 3A. When a need arises to replace the strap 108 while maintaining use of the base 106 and related structures, the user simply cuts the strap 108 adjacent the passages 126, 128 opposite the base 106. The resultant, cut base structure 382 is shown in FIG. 3B. As illustrated, the cut base structure 382 includes the band identification portion 118 and the passages 126, 128.

Figure 3C:
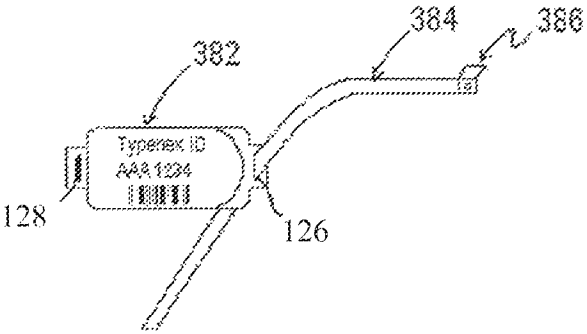
Figure 3D:
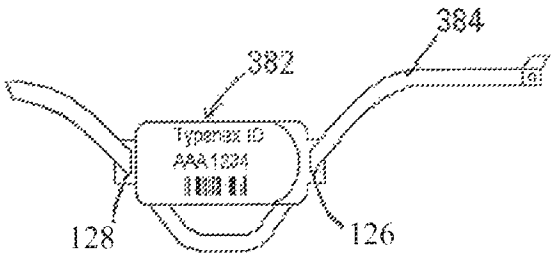
Figure 3E:
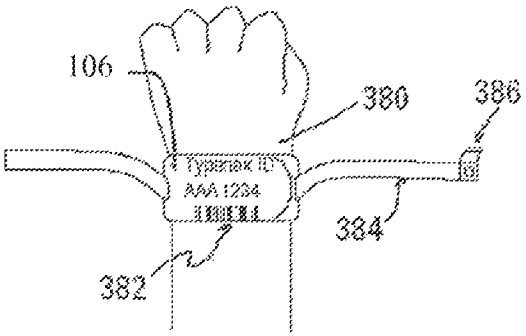

A replacement strap 384 is then provided and assembled to the base structure 382 as shown in FIGS. 3C and 3D. The replacement strap 384 can assume a variety of forms, and is generally constructed to be flexible, sized for placement through the passages 126, 128. Further, the replacement strap 384 can maintain a closure device 386. With this in mind, the replacement strap 384 can be threaded through the first passage 126, under the base structure 382, and through the second passage 128 (or vice-versa). Once so-connected, the replacement strap 384 can be secured about the recipient's appendage 380 as shown in FIG. 3E, for example by deployment of the closure device 386. While the passages 126, 128 are illustrated as being closed-ended slots, other configurations are also acceptable (e.g., holes, perforations, slots open to an edge of the base 106, etc.).

The strap 108 shown in FIG. 1B extends from the base 106 and is sized for placement about a recipient's appendage (e.g., wrist or ankle). The strap 108 terminates at a tail end 132 and is adapted for placement about a recipient's wrist, ankle, or other appendage. For reference, FIGS. 1A, 1B, and 1C illustrate the recipient verification system 100 prior to placement about the recipient's appendage.

The closure 111 is used to secure the strap 108 around the recipient's appendage. The closure 111 shown in the embodiment of FIGS. 1A, 1B, 1C, is a snap closure commonly known in the art. In general, the closure 111 is comprised of two mating components designed to engage one another in a single-use, tamper-evident fashion. In alternative embodiments, the closure 111 may be comprised of other various closures commonly known to those skilled in the art, including adhesive closures, hook and loop closures, external clip closures, etc.

As shown in FIG. 1C, the shield 110 is attached to the base 106 and includes a transparent or substantially transparent film layer 134 with an adhesive lining. An optional release liner 146 can be provided with the shield 110 to prevent premature activation or exposure of the adhesive on the shield film layer 134. The shield 110 further defines a leading end 142*a* and a trailing end 142*b*. In the initial state (i.e. prior to physical connection of the recipient verification system 100 to a recipient), the leading end 142*a* is free of the base 106 and can move relative to the base 106. The trailing end 142*b* is attached to the base 106 at an exposed adhesive area or adhesive attachment area 150. Exposed adhesive area 150 is shown in FIG. 1C as being proximal to the closure 111, but the shield 110 may also be oriented with the exposed adhesive area 150 distal to the closure 111 and proximal to second passage 128. In this alternate embodiment, the exposed adhesive area 150 on the shield 110 can be utilized as a combination attachment feature for the shield 110 as well as a protective covering for the permanent label 160. Upon final assembly of the recipient verification system 100 to a recipient, the leading end 142*a* of the shield 110 is adhered to the base 106. In some embodiments, the shield 110 is sized to completely cover the recipient information portion 122 and the permanent label 160 while terminating at the second passage 128.

The shield 110 can be made of a clear material that facilitates legibility of the predetermined band identifier 112 code and scanning/reading of barcodes or other communication means (RFID, etc.) In one embodiment, the shield 110 is a single piece of material attached to the base 106 via the exposed adhesive area 150 as described above. Upon application, the shield 110 in this embodiment simultaneously protects both the recipient information portion 122 and the permanent label 160. In embodiments where the permanent label 160 is sufficiently durable, the shield 110 may be sized to protect only the recipient information portion 122.

In further embodiments, the shield 110 may be comprised of two separate pieces to separately protect the recipient information area 122 and the permanent label 160. In these constructions, each piece of the shield 110 has its own adhesive attachment area 150. In alternate embodiments, the adhesive attachment area 150 that attaches the shield 110 to the base 106 can be replaced with an ultrasonic weld, solvent bond, or other attachment means. In other embodiments, the shield 110 has points or lines of weakness at its leading end 142*a* to promote tamper evidence if the shield 110 is removed after application.

The band 102 can be formed and assembled in a variety of manners. In some embodiments, the band 102 is initially defined as a die-cut, single or multi-layer laminate structure, formed apart from the label strip 104 (i.e., the band 102 and the label strip 104 are not commonly defined in a single contiguous form-like structure). The strap 108 is integrally formed with the base 106 such that the base 106 and the strap 108 form a contiguous, homogeneous body. The laminate material(s) are selected to be flexible, resistant to tearing, durable, acceptable for contact with human skin, and take into account patient comfort. For example, acceptable laminate material(s) include polyethylene, polyester, vinyl, nonwoven foams, low-density polyethylene/COC blends, Tyvek™, etc. Alternatively, the base 106 and the strap 108 can be formed of differing materials. For example, the strap 108 can be Tyvek™ to allow for comfort, while the base 106 can be polyethylene to provide a more structured support for the label strip 104.

As shown in FIG. 1A, the label strip 104 is composed of the permanent label 160, a plurality of removable labels 162, a test tube label 164, a plurality of detachable labels 166, and an adhesive strip 176. The size, shape, and/or number of the removable labels 162, test tube label 164, detachable labels 166 can vary as desired; however, at least one removable label 162 (apart from the permanent label 160) is provided with the label strip 104. The band identifier 112 is identically displayed (e.g., printed) by the permanent label 160 as well as the at least one removable label 162, at least one of the detachable labels 166, and the test tube label 164; in some embodiments, the band identifier 112 is displayed by every discrete label defined by the label strip 104. In one embodiment, the label strip 104 is printed onto one continuous backing comprising a facestock layer 173 and a liner layer 174 as shown in FIG. 1C. Additional liner layers, such as layer 181, may be added to sections of the label strip 104 as needed to enhance system 100 durability.

The label strip 104 is formed separately from the band 102. In some embodiments, the label strip 104 is subsequently adhered to the base 106 by the permanent label 160 at the band identification portion 118. In general, the remaining portions of the label strip 104 may move independently of the band strap 108. This independence allows the band strap 108 to be sized and secured around a patient while allowing the label strip 104 to remain secured to the base 106 and fully intact. This attachment of the label strip 104 to the base 106 creates a physical link between the two components 104, 106 and minimizes the likelihood that either component will be separated and misplaced during band application. In alternative embodiments, the label strip 104 may be positioned on various other locations along the band 102. The location of the label strip 104 relative to the band 102 is not limited by what is described herein. In general, the label strip 104 may be divided into two regions by a line or area of weakness 172: a removable label region 184 and a detachable label region 186. The functions of each region are detailed in later paragraphs.

FIG. 1C shows the adhesive strip 176 beneath both the removable label region 184 and the detachable label region 186. The adhesive strip 176 contains an adhesive layer 178 covered by a liner 175. In one embodiment, the adhesive strip 176 is placed across the area of weakness 172 between the both removable label region 184 and the detachable label region 186. The area of weakness 172 divides the adhesive strip 176 into a leading segment 180*a* and a trailing segment 180*b*. In alternative embodiments, the adhesive strip 176 may be composed of two independent adhesive strips, one positioned beneath the removable label region 184 and another positioned beneath the detachable label region 186. In general, a width of the adhesive strip 176 is equal to or less than a width of the label strip 104. Optionally, a width of the adhesive strip 176 along at least the trailing segment 180*b* approximates or is slightly smaller than a width of the strap 108. In another embodiment, the removable label region 184 may be secured to the band without the use of an adhesive strip 176. In this embodiment, an additional passage similar to passages 126, 128 may be provided in the removable label region 184 and sized to receive the strap 108 prior to securing the strap 108 at the closure 111.

The removable labels 162 are positioned or formed on or by the label strip 104 in a section noted as the removable label region 184. Because this region 184 is a section of the label strip 104, the region 184 may move independently of the band strap 108 prior to application of the band 102 to a recipient as described above. By allowing this independent motion of the removable label region 184, obstruction of the strap 108 by the region 184 is avoided during band application. Once the strap 108 is secured to the closure 111 during band application, the removable label region 184 may be secured to the strap 108 by removing the adhesive liner 175 from the trailing segment 180*b* of the adhesive strip 176 and effectuating a bond between the thusly exposed adhesive and the strap 108. Notably, the leading segment 180*a* may continue to be covered by a remaining portion of the liner 175. By securing the removable label region 184 to the strap 108 in the worn state, the removable labels 162 are more robustly connected to the band 102 and more readily remain with the band 102 while it is worn by the recipient.

In some embodiments, the removable labels 162 are configured such that the label perimeter is not adjacent to the border of the removable label region 184. That is to say, while a width of the removable label region 184 may or may not be the same as the width of the band base 106, a perimeter of each individual removable label 162 (for example as conventionally cut into the facestock layer 173 of the label strip 104) terminates interior of the base 106 width or border. This configuration can render the removable labels 162 much more resistant to falling off while the system 100 is worn on a recipient (during showers, etc.).

The detachable labels 166 are positioned or formed on or by the label strip 104 in a section noted as the detachable label region 186. During use, the detachable label region 186 is first detached along the area of weakness 172 after attachment of the band 102 to the recipient. The detachable label region 186 can then be adhered to various articles (e.g. specimen tubes, etc.) by removing the adhesive liner 175 beneath the leading end 180*a* of the adhesive strip 176.

It is desirable that the permanent label 160, removable labels 162, test tube label 164, and detachable labels 166 are identical in their markings to ensure patient safety. Removable labels 162 and detachable labels 166 can be provided in any quantity or format (e.g. machine-readable, human-readable) desired by the user. In one embodiment shown in FIG. 1A, the detachable labels 166 may contain machine readable codes (e.g. barcodes) that span several labels and are divided by the border of each discreet detachable label 166.

The predetermined band identifier 112 displayed on the label strip 104 is created on a variable basis by a manufacturer of the recipient verification system 100 (as opposed to a caregiver institution user of the recipient verification system 100 or the recipient). The predetermined band identifier 112 can be indicia in one or more formats or configurations depending on the situation and process needs. For example, in some exemplary embodiments, the predetermined band identifier 112 includes a unique band code that is generated in one or more forms such as alphanumeric, barcode, magnetic stripe, RFID, etc. Alternatively, the predetermined band identifier 112 indicia can assume other forms (such as prompts, instructions, icons, etc.) or be omitted. The recipient verification system 100 can contain colors, icons, or other means that aid caregivers and patients in identifying the purpose/intent of the recipient verification system 100.

A different, predetermined band identifier 112 code can be created for each new recipient verification system 100 supplied to an institution. In practice, the institution optionally maintains an electronic database (or written record) that assigns the predetermined band identifier 112 code to a particular recipient to whom the recipient verification system 100 is applied. Subsequently, that same, predetermined band identifier 112 code is then correlated in the database with relevant recipient information. For example, the recipient can be a patient admitted to a hospital and submitting test specimen(s) at a laboratory.

In general, the process for the application and use of the recipient verification system 100 can proceed as follows. First, any hospital label, card, tab, or other carrier mechanism will be transcribed with desired information, for example recipient, caregiver, and/or other hospital related information. The resultant recipient information label, which can come in any format or material per the specific hospital's procedure, is placed in, and bonded to, the recipient information portion 122. The shield 110 is then sealed down over the so-applied recipient information label and the permanent label 160 by first removing the release liner 146 and then sealing the shield 110 to the base 106. This provides protection to the applied recipient information label and permanent label 160.

The recipient verification system 100 is connected to a recipient by wrapping the strap 108 about the recipient's appendage and securing the band closure 111. Once the recipient verification system 100 is attached to the recipient, the remaining length of the strap 108 can be stored by inserting it into the first passage 126. In other embodiments, the excess strap 108 material can be removed (if desired) using a scissor or equivalent means.

Once the recipient verification system 100 is attached to the recipient, the test tube label 164 can be removed and placed on any number of specimen carrying vehicles. Then, the detachable label region 186 can be removed at the area of weakness 172. The detachable label region 186 travels with the specimen (or specimen carrying vehicles), and the detachable labels 166 can be attached to the specimen or any paperwork, etc., via the adhesive strip 176 leading segment 180*a* (that otherwise remains with the detachable label region 186 upon detachment of the detachable region 186 from the removable label region 184). In some embodiments, the leading segment 180*a* of the adhesive strip 176 is attached to the recipient sample tube prior to applying the recipient verification system 100 to the patient and/or drawing the patient sample.

The removable labels 162 remain with the recipient in case they are needed to label anything related to the recipient (another specimen, paperwork, etc.) at a later time. The permanent label 160, removable labels 162, test tube label 164, and detachable labels 166 all display the same predetermined band identifier 112. Subsequently, when the labels 162-166 are placed on any specimen, order form, paperwork, drugs, organs, tissues, or blood being delivered to the recipient, the labels 162-166 can be compared against the band identifier 112 on the permanent label 160 to enable recipient verification.

The recipient information label (e.g., hospital label or other applied information) secured to the recipient information portion 122 can be accessed for further recipient identification by comparing applied information on the recipient information label to medical records, for instance. In some embodiments, the predetermined band identifier 112 on the permanent label 160 is read and/or used to ensure proper delivery of recipient intended products using a bedside scanning device. Additionally, a printer system and label stock can be used to make more of the detachable labels 166 at the point of use as needed.

Figure 2A:
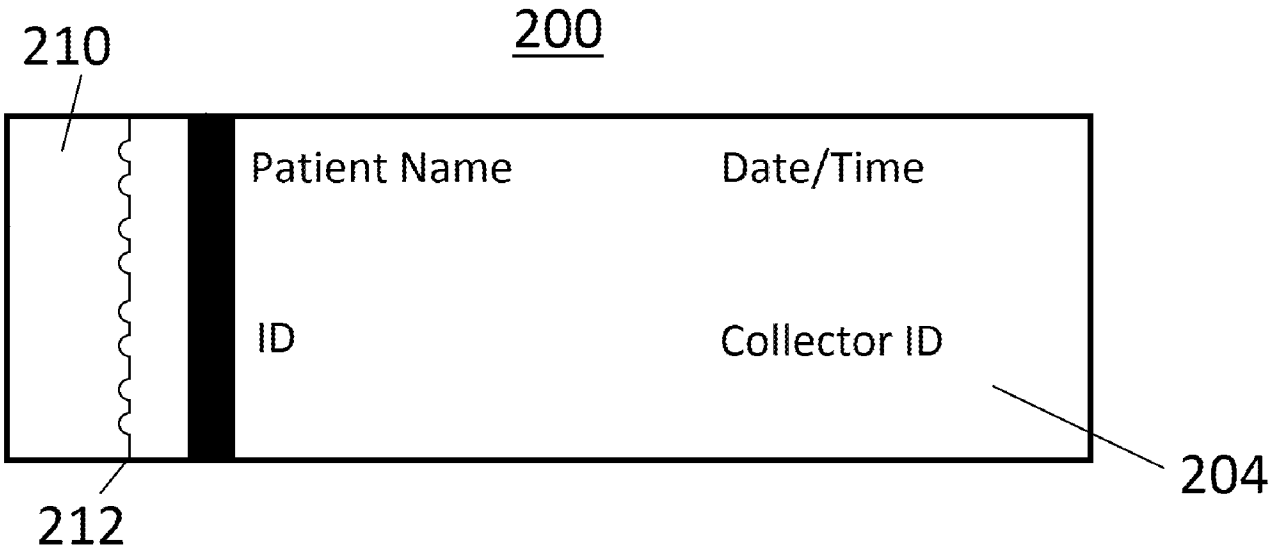
FIG. 2A is a simplified top view of the write-on label construction supplemental component useful with systems of the present disclosure.
Figure 2B:
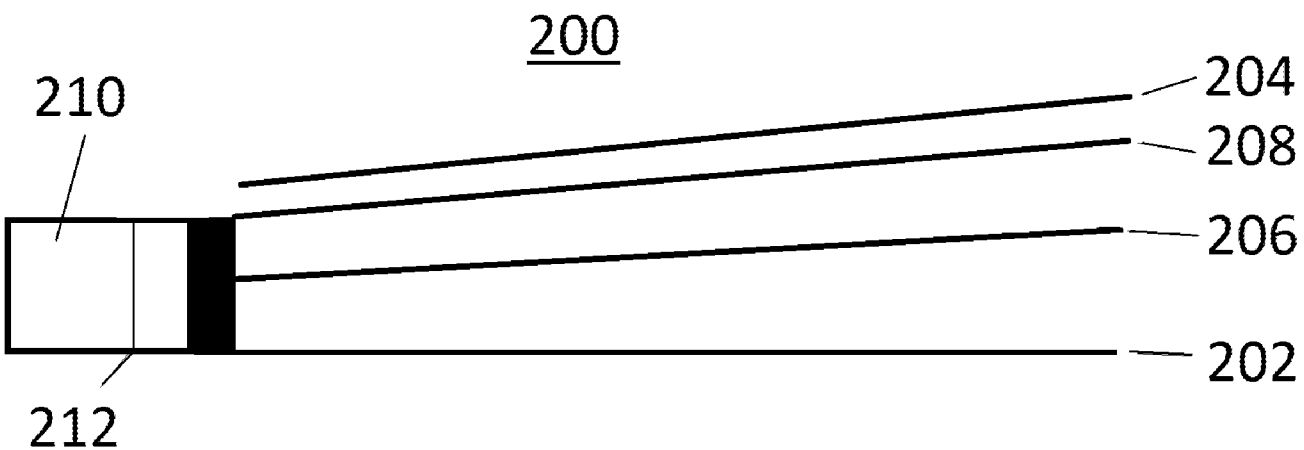
FIG. 2B is a side view of the write-on label construction supplemental component of FIG. 2A.

In some institutions or applications, preprinted hospital labels are not available, and/or handwritten label formats are preferred. Under these circumstances, the recipient information portion 122 can be formatted to be ink-receptive for receiving hand-written information. It is desirable to avoid transcription errors and ensure that the information on the patient-attached portion of the recipient verification system 100 is identical to that on the specimen or other recipient related vehicle. FIGS. 2A and 2B show top and side views of a write-on label construction 200 useful for achieving these requirements. The write-on label construction 200 may be used as a supplemental component of the recipient verification system 100 shown in FIGS. 1A-1C.

During manufacturing, the write-on label construction 200 may be adhered over the recipient information portion 122. A label/face stock layer 204 displays prompts that suggest desirable information that can be written on to the label/face stock layer 204 using, for example, a ballpoint pen. Desired information is written onto the label/face stock layer 204 and is transferred via image transfer paper, carbon paper or similar material layer(s) 206 to the desired surface. The label layer 204 that is intended for the recipient specimen or other recipient-related items is removed from a corresponding release liner 208 and applied as desired. In some embodiments, a liner layer 202 may protect image material carried by the write-on label construction 200 from premature transfer. The liner layer 202 is removed prior to writing. In some embodiments, the liner layer 202, label/face stock layer 204 and the image transfer paper layer 206 are attached to one another for convenience of use by a connector piece 210. Layers such as the liner layer 208 can be removed via a weakened area 212 located between the layers 202-208 and the connector 210. This information write-on label construction 200 can stand alone, or be attached to the recipient information portion 122 in a variety of ways, including during the initial manufacturing of the recipient verification system 100.

In other embodiments, the band 102 may be comprised of some or all of the layers 202-208 shown on the write-on label construction 200. By using the same layers between the write-on label construction 200 and the band 102, the manufacturing of the subsequent recipient verification system 100 would be simplified. In alternative embodiments, said layers 202-208 of the write-on label construction 200 may comprise only a section of the band 102 rather than the whole band.

In further embodiments, the label strip 104 may also be comprised of some or all the layers 202-208 shown on the write-on label construction 200. In these embodiments, some or all of the layers 202-208 could extend into the recipient information portion 122 and be configured to receive patient-related information.

The recipient verification systems, methods of manufacture, and methods of use of the present disclosure provide marked improvements over previous designs. In contrast to conventional "all-in-one" or form-based systems in which the band and the label strip are simultaneously formed from the same stock material sheet, by forming the band and the label strip as separate components, the systems of the present disclosure permit the use of desired materials for each discrete component (e.g., the material use for the band can be strong, tamper evident and durable, while the material used for the label strip can be soft, easy to process and print on). With embodiments in which the label strip and the band are not coextensive (e.g., the two components do not fully overlap), the label strip is secured to the band in a small section and the remaining portion of the label strip hangs freely. This independence between the label strip and the band allows the band strap to be more easily sized and secured to the recipient while the label strip is still physically linked to the band.

Although the present disclosure has been described with reference to preferred embodiments, workers skilled in the art will recognize that changes can be made in form and detail without departing from the spirit and scope of the present disclosure.

What is claimed is:

1. A recipient verification system comprising:

a primary band including:

a base defining a band identification portion for displaying a recipient identifier, first and second slots formed through a thickness of the band, a strap defining a first end, a second end opposite the first end, and an intermediate segment between the first and second ends, wherein the first end is contiguously formed with the base such that the strap extends from the base to the second end, a closure device attached to the base opposite the first end of the strap; and a secondary band provided apart from the primary band;

wherein the primary band is configured to provide a primary worn state of the system in which the intermediate segment of the strap is looped about a recipient's appendage and is secured relative to the base by the closure device independent of the slots;

and further wherein the system is configured to provide a replacement worn state in which the secondary band is looped about recipient's appendage and is assembled to the base via the slots.

2. The system of claim 1, wherein the first and second slots are formed at opposite sides of the band identification portion, respectively, such that the band identification portion is between the first and second slots.

3. The system of claim 1, wherein the primary worn state includes the strap permanently secured to the closure device.

4. The system of claim 1, wherein the base defines opposing, first and second sides, and further wherein the first end of the strap is adjacent the first side and the closure device is adjacent the second side.

5. The system of claim 4, wherein the first slot is formed between the band identification portion and the first end of the strap, and the second slot is formed between the band identification portion and the closure device.

6. The system of claim 1, wherein extension of the strap from the base defines a length direction of the primary band, the primary band further defining a width direction perpendicular to the length direction, and further wherein a width of each of the slots in the width direction is greater than a width of the strap in the width direction.

7. The system of claim 1, wherein extension of the strap from the base defines a length direction of the primary band, the primary band further defining a width direction perpendicular to the length direction, and further wherein the width of each of the slots in the width direction is less than a width of the strap in the width direction.

8. The system of claim 1, wherein the replacement worn state includes the closure device and a majority of the strap removed from the base.

9. The system of claim 1, wherein the recipient identifier remains with the base in the primary worn state and the replacement worn state.

10. The system of claim 1, wherein a major dimension of each of the slots is less than a width of the base and is greater than a width of the secondary band.

11. The system of claim 10, wherein the major dimension of each of the slots is less than a width of the strap.

12. The system of claim 1, further comprising a label strip attached to the primary band and carrying at least one detachable label.

13. The system of claim 12, wherein the primary band further includes a recipient identifier displayed on the band identification portion, and further wherein the recipient identifier is a predetermined code, and even further wherein the predetermined code is displayed on the detachable label.

14. The system of claim 1, wherein the primary band further includes a recipient identifier displayed on the band identification portion, and further wherein the recipient identifier includes at least one of a predetermined code and recipient identification information.

15. The system of claim 1, wherein the primary band further includes a recipient identifier displayed on the band identification portion, and further wherein the recipient identifier is displayed on a label applied to the band identification portion.

16. A method of applying a recipient verification system to a recipient, the method comprising:

receiving a band including:

a base defining a band identification portion for displaying a recipient identifier, first and second slots formed through a thickness of the band, a strap defining a first end, a second end opposite the first end, and an intermediate segment between the first and second ends, wherein the first end is contiguously formed with the base such that the strap extends from the base to the second end, a closure device attached to the base opposite the first end of the strap;

looping the intermediate segment of the strap about an appendage of the recipient;

securing the intermediate segment to the closure device to establish a primary worn state in which the band is secured to the recipient's appendage;

wherein the step of securing the intermediate segment to the closure device is characterized by the strap not passing through either of the first and second slots;

severing the base from the closure device and a majority of the strap to detach the band from the recipient's appendage following the step of securing the intermediate segment to the closure device;

assembling a secondary band to the first and second slots;

looping the secondary band about the recipient's appendage; and securing the secondary band to establish a replacement worn state in which the base is secured to the recipient's appendage.

17. The method of claim 16, wherein the recipient identifier is displayed by the base in the primary worn state and the replacement worn state.

18. The method of claim 16, wherein the step of severing the base includes forming a first cut line in the base between the first slot and the strap, and forming a second cut line in the base between the second slot and the closure device.

* * * * *